US005272982A

United States Patent [19]

Desevaux et al.

[11] Patent Number: 5,272,982

[45] Date of Patent: Dec. 28, 1993

[54] DEVICE FOR MAINTAINING A PROJECTILE RELATIVE TO THE CASING OF A TELESCOPING AMMUNITION

[75] Inventors: Michel Desevaux; Pierre Ducros, both of Bourges, France

[73] Assignee: GIAT Industries, France

[21] Appl. No.: 941,312

[22] Filed: Sep. 4, 1992

Related U.S. Application Data

[60] Division of Ser. No. 863,477, Apr. 2, 1992, Pat. No. 5,163,165, which is a continuation of Ser. No. 531,150, May 31, 1990, abandoned.

[30] Foreign Application Priority Data

Jun. 1, 1989 [FR] France ..... 89 07231

[51] Int. Cl.[5] ..... F42B 5/045

[52] U.S. Cl. ..... 102/434; 102/439; 102/466

[58] Field of Search ..... 102/430, 433, 434, 439, 102/443, 464, 520, 466, 467

[56] References Cited

U.S. PATENT DOCUMENTS

| | | | |
|---|---|---|---|
| H61 | 5/1986 | Yuhash et al. | 102/434 |
| 2,996,988 | 8/1961 | Kunz | 102/430 |
| 3,009,394 | 11/1961 | Kamp et al. | 102/430 |
| 3,046,890 | 7/1962 | Dardick | 102/439 |
| 3,575,112 | 4/1971 | Farmer . | |
| 3,735,664 | 5/1973 | Hermle | 102/520 |
| 3,817,148 | 6/1974 | Schirneker | 102/439 |
| 3,978,792 | 9/1976 | Campolí et al. | 102/430 |
| 4,015,527 | 4/1977 | Evans . | |
| 4,024,819 | 5/1977 | Schirnecker | 102/434 |
| 4,444,115 | 4/1984 | Romer et al. | 102/430 |
| 4,770,098 | 9/1988 | Stoner | 102/434 |
| 4,967,668 | 11/1990 | Warren | 102/439 |

FOREIGN PATENT DOCUMENTS

| | | | |
|---|---|---|---|
| 0152492 | 8/1985 | European Pat. Off. . | |
| 18238 | 6/1882 | Fed. Rep. of Germany | 102/430 |
| 2131393 | 11/1972 | France . | |
| 2606500 | 5/1988 | France . | |
| 1310607 | 3/1973 | United Kingdom . | |

*Primary Examiner*—Harold J. Tudor

*Attorney, Agent, or Firm*—Parkhurst, Wendel & Rossi

[57] ABSTRACT

A telescoped ammunition cartridge, including a cylindrical cartridge casing having one end closed by a base, a full caliber projectile disposed within the casing, wherein the projectile has a cylindrical aft section and a tapered fore-section, at least one annular sleeve fitted in the casing at a fore-section thereof, wherein only the fore-section of the projectile is located within the annular sleeve. Further, the cartridge includes a detachable nose fairing fitted inside and contacting the annular sleeve to form a nose fairing sleeve assembly, wherein the nose fairing is integral with the projectile and is located at the tapered fore-section of the projectile, the assembly defining a support for the tapered fore-section of the projectile. The cartridge advantageously includes fixed supports defined by elongated ridges fitted between the nose fairing and the casing and extending to the aft section of the projectile to provide support therefor, wherein spaces are defined between the fixed supports. A propellant charge is disposed within the casing and is in contact with the cylindrical aft section of the projectile, and is disposed within the spaces of the fixed supports.

2 Claims, 7 Drawing Sheets

DEVICE FOR MAINTAINING A PROJECTILE RELATIVE TO THE CASING OF A TELESCOPING AMMUNITION

This is a division of application Ser. No. 07/863,477 filed Apr. 2, 1991 now U.S. Pat. No. 5,783,165 which in turn is a Rule 62 continuation of application Ser. No. 07/531,150 filed May 31, 1990, now abandoned.

BACKGROUND OF THE INVENTION

The invention relates to a device for holding a projectile in relation to the casing of a telescoped ammunition round wherein the projectile is confined to the cartridge case.

Telescoped ammunition which have given rise to many developments in the last few years, are characterized in that the projectile is disposed inside the cartridge casing containing the propelling charge instead of protruding outside the latter.

The main advantage of such an arrangement is that, it makes it possible to define shorter ammunition rounds, which enables more compact or higher-rate-of-fire weapons to be designed.

However, in developing of such ammunition rounds, to a number of difficulties arise.

For example, the projectile is not introduced into the weapon barrel when the round is disposed in the chamber and it is the pressure due to the combustion of the grain charge gases which first introduces the projectile into the barrel.

In order to obtain the same ballistic performance as that of a conventional round, it is desirable to fill the cartridge case of the round with the greatest possible quantity of propellent powder, which imposes the presence of an annular layer of this powder around the projectile.

Upon ignition, it is to be feared that the combustion gases will precede the projectile before the latter has entered into the barrel deeply enough to ensure gas-tightness.

Various solutions have been envisaged to avoid this phenomenon; as an example, U.S. Pat. No. 4,604,954 describes an ammunition round wherein a first grain charge, contained in a small cylinder, acts only upon the projectile through a piston sliding in this cylinder; the main grain charge surrounding the projectile is ignited only when the latter has entered into the weapon barrel.

Such an ammunition round is complex because it requires the assembly of several parts of fine mechanics; moreover, the transition between the combustion of the first grain charge and that of the second grain charge is difficult to control, which may reduce the efficiency of the propellent charge, and thus the performance of the ammunition round.

U.S. Pat. No. 4,770,098 proposes an ammunition round wherein a sleeve closes the fore section of the cartridge casing, this sleeve of plastic material includes a hole the diameter of which is slightly smaller than that of the projectile.

So, the projectile is immobilized by the sleeve thus providing gas tightness for gases from the combustion of the propellin charge.

The sleeve also permits placement of the projectile in relation to the cartridge casing, thus also to the weapon barrel; a number of holes permit variance of the sleeve stiffness and thus the minimum pressure required for setting the projectile in motion.

Such a concept of ammunition round is particularly interesting because it makes it possible to produce telescoped ammunition with a single propelling charge.

However, the sleeve is not sufficient for holding the projectile and, therefore, the inner surface of the cartridge casing includes axial ribs intended to support the aft section of the projectile.

These ribs reduce the volume available for the powder and may disturb the ignition regularity.

It might seem advantageous to suppress the ribs, but this would require the use of a sleeve with a large surface of contact with the projectile, a solution which is not acceptable because a long sleeve reduce the volume available for the powder.

GB patent 1310607 shows a telescoped ammunition round comprising a casing fitted with radial ribs which support the projectile, and a plug which provides for gas-tightness and ensures a maximum axial holding of the projectile in relation to the casing.

This arrangement present the same disadvantages as that of U.S. Pat. No. 4,770,098 (i.e., the ribs support the projectile radially but limit the volume available for the propelling charge).

U.S. Pat. No. 3,575,112 describes a compact ammunition round comprising a plurality of molded propelling charge elements.

The projectile is disposed in a hole of this solid charge and is supported radially by the solid charge; a washer provides for the axial positioning of the projectile and is glued to the propelling charge.

The washer is not integral with the projectile, which implies that, in case of a break in the propellent grains due to mechanical stresses during projectile introduction into the weapon barrel, the projectile will not be supported radially.

This arrangement is inconvenient since the ammunition round does not include a casing containing the grain charge and the washer is glued on the charge itself which runs the risk of breaking.

U.S. Pat. No. 4,015,527 shows an amunition round also comprising a plurality of molded propelling charges disposed within a combustible casing which is not closed by a sleeve.

The object of the invention is to propose a device for holding a projectile in relation to the casing of a telescoped ammunition round which does not present such disadvantages.

SUMMARY OF THE INVENTION

So, the object of the invention is a device for holding a projectile in relation to the casing of a telescoped ammunition round comprising at least one annular sleeve fitted to the casing and accommodating the projectile, and a nose fairing fitted inside the sleeve, this holding device being characterized in that the nose fairing is integral with the projectile at the location of the fore section of the projectile.

If the projectile is of the subcaliber type, fin stabilized and housed in a sabot of the same caliber as the weapon barrel, the nose fairing can be integral with the sabot.

If the projectile is of the spin-stabilized type and comprises a ballistic warhead, the nose fairing can be made integral with the projectile at the location of the ballistic warhead.

The holding device according to the invention can also include means for supporting the projectile on the casing at its aft section.

According to a particular mode-of embodiment, these supporting means include a shim integral with the projectile at its aft section.

According to another mode of embodiment, the support means include at least three lugs integral with the sleeve at its aft section, evenly spaced from one another and extending in an axial direction.

According to a variant, the casing includes at least one bulge on its inner surface and the shim rests on this bulge.

Preferably, the shim will include at least three arms evenly spaced from one another; it can also be integral with the sabot or with the fin assembly.

BRIEF DESCRIPTION OF THE DRAWINGS

The invention will be understood more easily upon reading the following description of particular modes of embodiment taken in connection with the accompanying drawings in which.

DETAILED DESCRIPTION OF THE PREFERRED EMBODIMENTS

Figure 1:
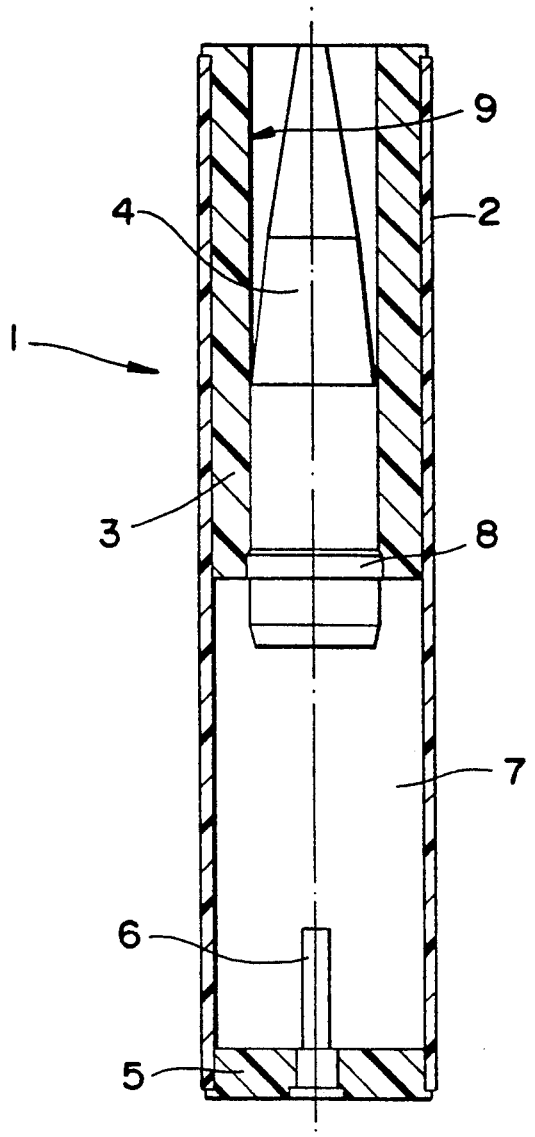
Fig- 1 PRIOR ART
FIG. 1 is an axial sectional view of a telescoped ammunition round according to the state of the art.

Referring to FIG. 1, a telescoped ammunition round 1 of the same type as the round described in U.S. Pat. No. 4,770,098 comprises a casing 2, made preferably of plastic material, and closed at one aft end by a base 5, also of plastic material, which carries an igniter 6 of a known type.

The casing contains propelling charge 7; it is closed at its fore end by an annular sleeve 3 also made of plastic material.

So, the sleeve 3 is a means for holding the projectile in relation to the casing, and thus in relation to the weapon. As such, it provides for a correct positioning of the projectile with regard to the weapon barrel (not shown).

A projectile 4, which is of the spin-stabilized type, is disposed in a cylindrical or slightly conical housing 9 of the sleeve 3.

The projectile and sleeve fitting is of the interference fit type, the sealing band 8 has a larger diameter than that of the cylindrical housing and thus achieves a local deformation of the bush.

Such a fitting ensures that the projectile is set in motion only when a certain pressure level has been reached within the casing.

Figure 2A:
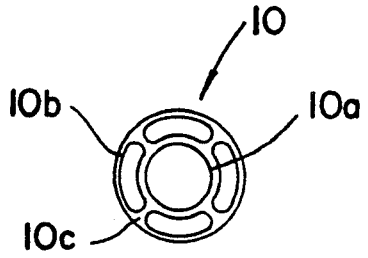
FIG. 2A is a front view of the nose fairing.
Figure 2:
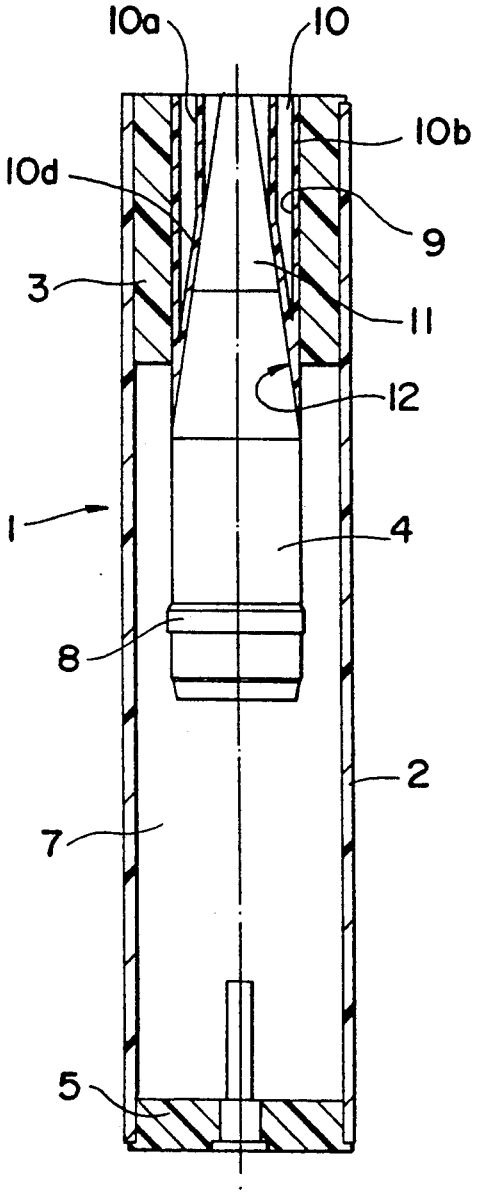
FIGS. 2 to 8 show various telescoped ammunition rounds incorporating various modes of embodiment of the holding means according to the invention.

FIG. 2 shows a compact ammunition round incorporating a first mode of embodiment of the holding means according to the invention.

The length of the sleeve 3 has been reduced, which has enabled the mass of propelling charge to be increased.

So, the aft section of the sleeve, which is in contact with the charge, comes substantially up to the conical fore section of the projectile.

The fore section of the projectile 4 carries a nose fairing 10, the inner profile of which corresponds to the outer profiles of the ballistic warhead 11 and of the outer surface 12 of the fore section of the projectile.

The nose fairing 10 is made integral with the projectile by gluing it to the projectile and it comprises an inner ring **10*a* and an outer ring 10*b* connected by radial partitions 10*c* and by a conical partition 10*d* (see FIG. 2A). The nose fairing 10** bursts out when coming out of the weapon barrel due to centrifugal force.

The nose fairing 10 is fitted tightly within the cylindrical housing 9 of the sleeve 3 so as to provide initial confinement of the grain charge as well as for gas-tightness before the band 8 is forced into the cylindrical housing 9.

Such a configuration has made it possible to hold the projectile by means of a sleeve of reduced dimensions and thus providing an increased mass of propelling charge while retaining a cartridge casing with a cylindrical inner profile.

In order to preclude, upon ignition, the drawbacks resulting from possible transverse pressure waves likely to bring about a slight tilting of the projectile and an incorrect introduction of the projectile into the weapon barrel, the sleeve 3 will have preferably such a length that it will be in contact with at least 50% of the outer surface of the nose fairing.

Figure 3A:
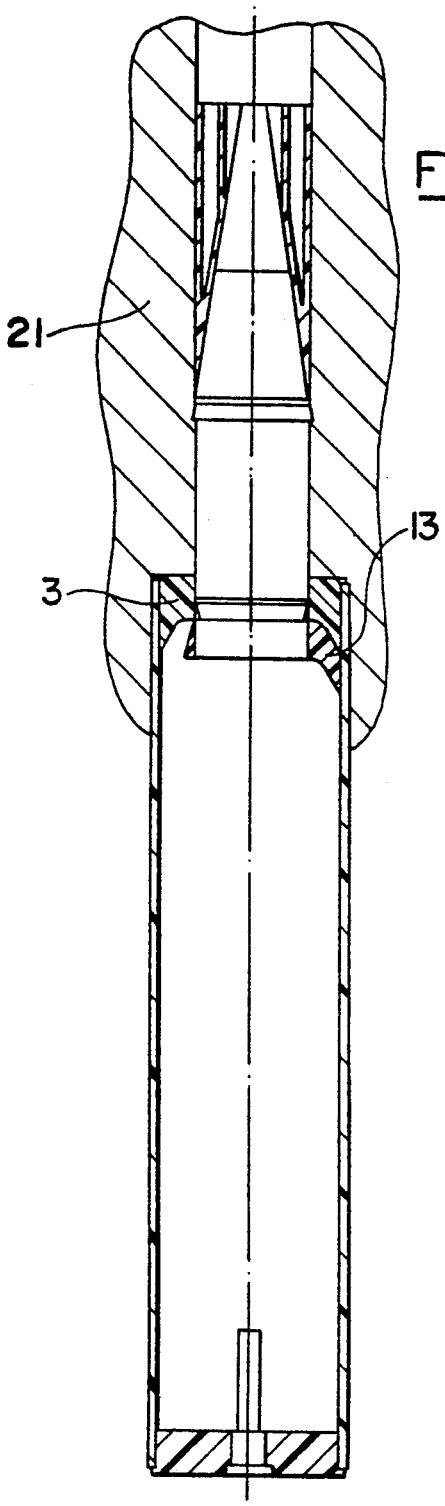
FIG. 3A shows the amunition round of FIG. 3 after ignition of the grain charge, when the projectile is about to leave the casing.
Figure 3:
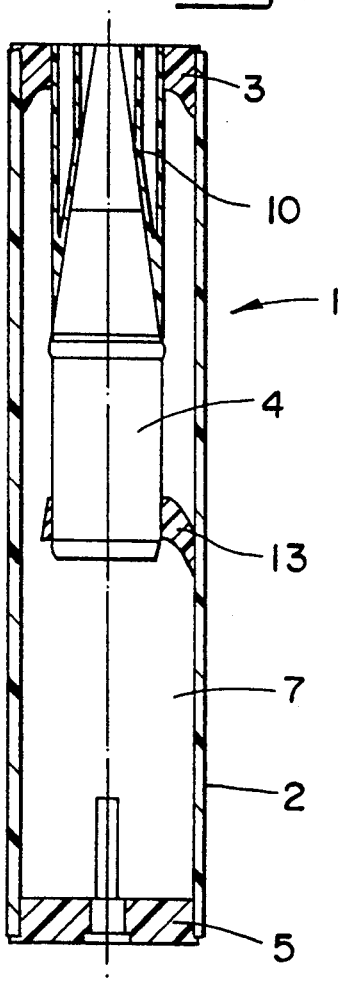

FIG. 3 shows another mode of embodiment of the holding means according to the invention.

For the purpose of increasing the mass of propelling charge contained in the casing, the fore sleeve has the minimum length compatible with its pressure resistance.

In addition to the sleeve 3 and the nose fairing 10, the holding means includes a shim 13 of plastic material integral with the projectile 4 at the location of its aft section.

Figure 3B:
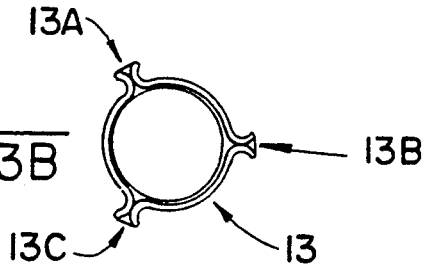
FIG. 3B shows a detail of FIG. 3.

This shim comprises-three evenly spaced arms **13*a*, 13*b*, 13*c*** (see FIG. 3B) consisting of the juxtaposition of three identical arcs.

The shim could also consist of a single piece.

The ends of the arms rest on the inner cylindrical surface of the casing 2.

In this particular mode of embodiment, the shim 13 completes the fore nose fairing which has not sufficient surface in contact with the sleeve to preclude a possible tilting of the projectile. The sleeve nose fairing assembly constitutes the means for holding the projectile in relation to the casing of the round.

FIG. 3A shows the projectile when it leaves the casing and is in the weapon barrel 21 illustrated schematically. The shim 13 is stopped and then broken by the sleeve 3; it is ejected from the casing after the projectile without disturbing the projectile trajectory or the weapon operation.

Figure 4A:
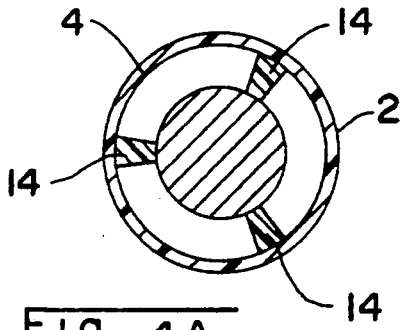
FIG. 4A is a cross-sectional view in plane A—A of FIG. 4.
Figure 4:
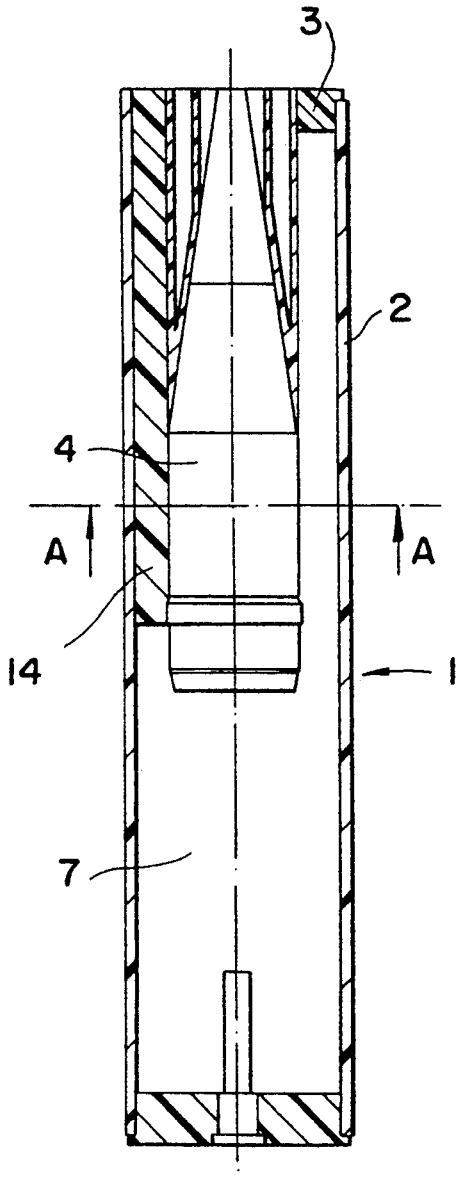

FIG. 4 illustrates another mode of embodiment of the invention wherein the sleeve 3 comprises, in its aft section, three evenly spaced lugs 14 (see FIG. 4A). The projectile is thus supported at its fore section by the nose fairing 10 and at its aft section by the lugs 14 of the sleeve 3.

It is possible to reduce the length of the cylindrical section of the sleeve to its minimum allowable value, which permits an increase of the mass of the propelling charge contained in the casing, the aft section of the projectile being supported by the lugs of the sleeve, which avoids the installation of a shim on the projectile.

Figure 5A:
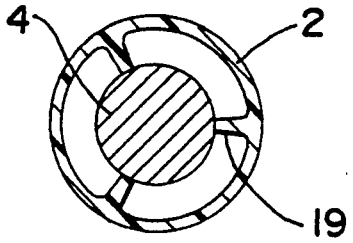
FIG. 5A is a-cross-sectional view in plane B—B of FIG. 5.
Figure 5:
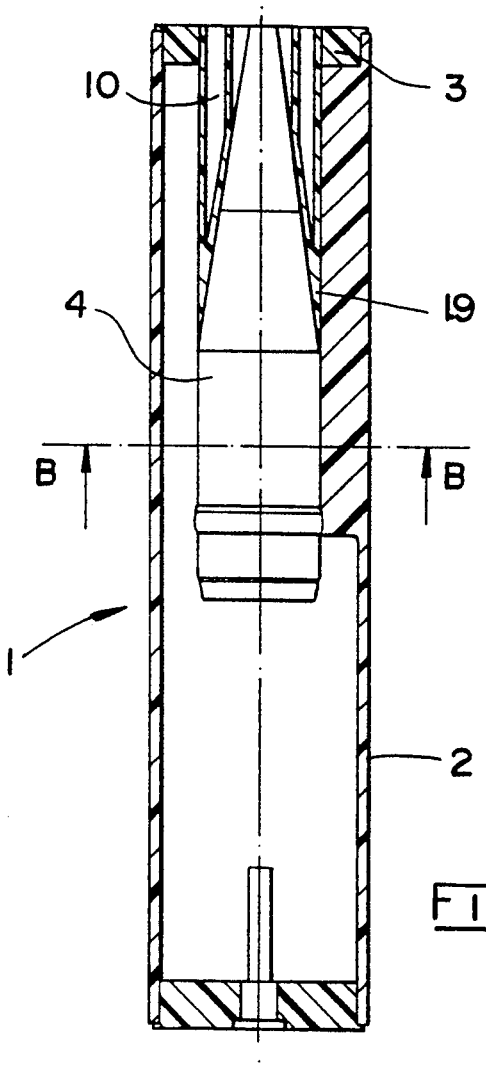

FIG. 5 shows another variant of the invention wherein the casing 2 of the round carries three evenly spaced bulges 19. The projectile is still supported at the location of its fore section by the nose fairing 10 and at its aft section by the bulges 19 of the casing 2 (see FIG. 5A).

Figure 6:
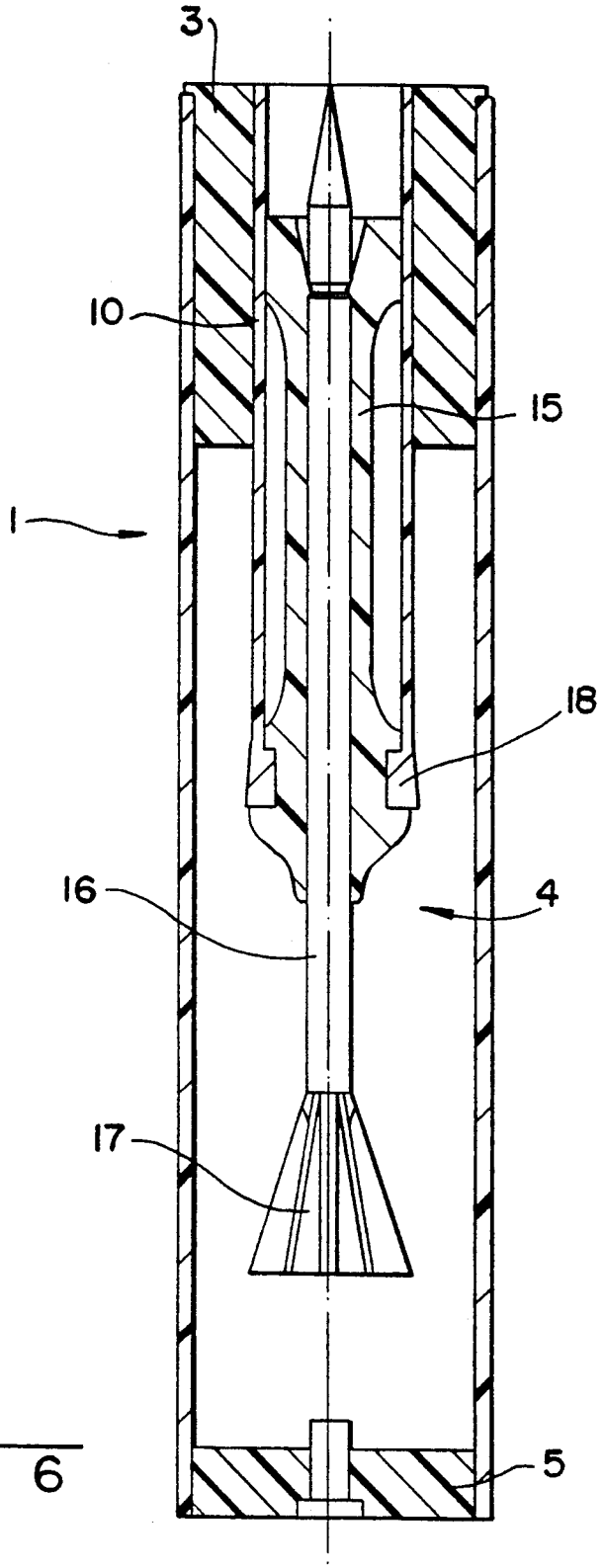
Figure 7:
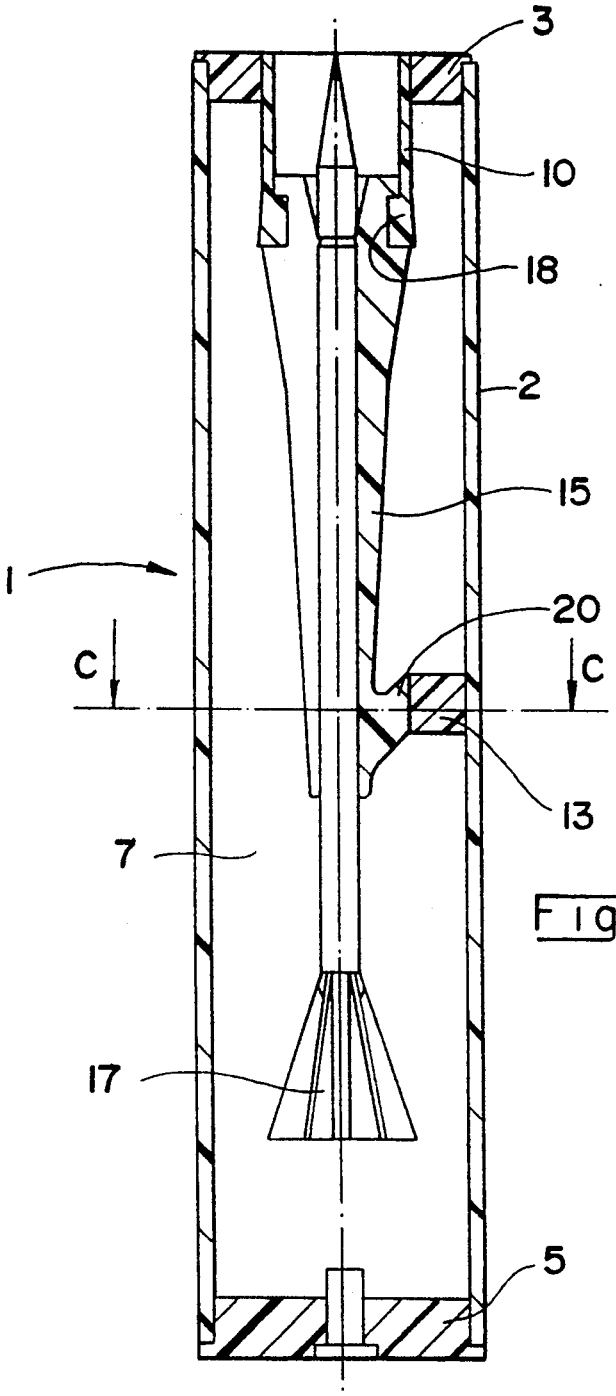
Figure 8:
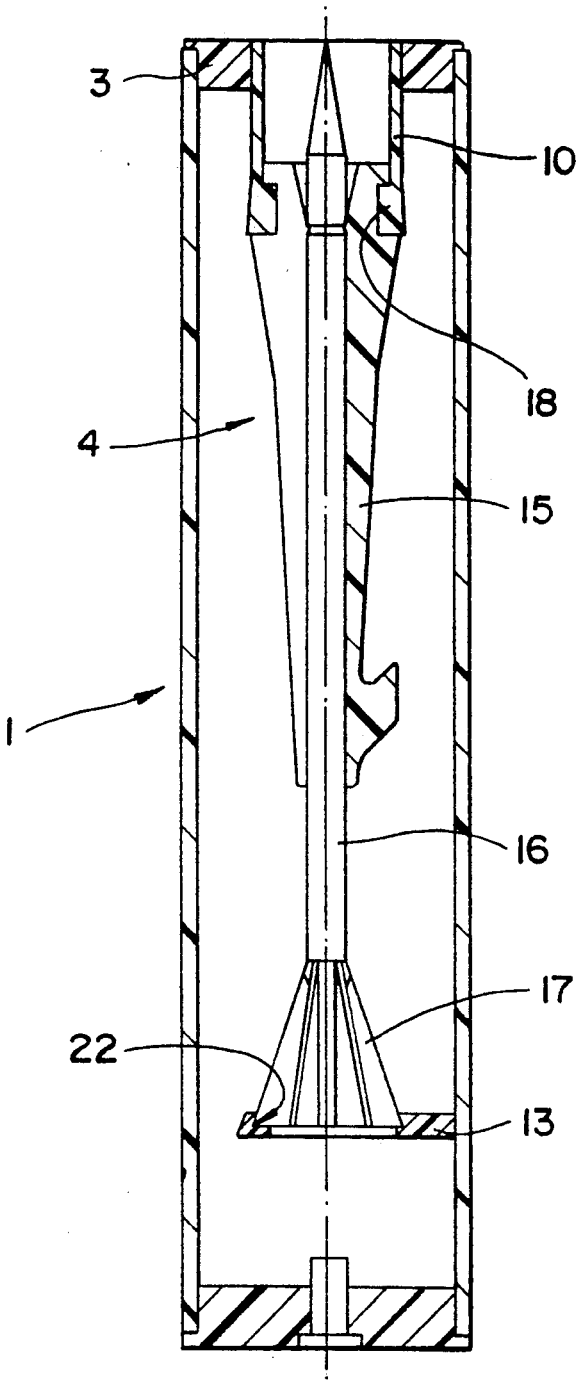

FIGS. 6 to 8 illustrate other modes of embodiment of the holding means according to the invention, intended for a compact ammunition round wherein the projectile 4 is of the subcaliber type and spin-stabilized by fins 17 and comprises a sub-projectile 16 integral with a sabot 15, consisting of a plurality of elements (generally three); a known sealing means (not shown), for example a silicone coating providing gas-tightness at the locations of the separations between the sabot elements.

Referring to FIG. 6, the nose fairing 10 is integral with the sabot 15 at a circular groove 18 machined in the sabot.

The nose fairing provides propellent gas-tightness inside the weapon barrel and thus acts as a band.

In this particular mode of embodiment, the nose fairing 10, made of plastic material, is injected onto the sabot, made of aluminum alloy, already equipped With the sub-projectile 16.

In order to preclude, upon ignition, the drawbacks resulting from possible transverse pressure waves likely to bring about a slight tilting of the projectile and an incorrect introduction of the projectile into the weapon barrel, the sleeve will have preferably such a length that it will be in contact with at least 50% of the outer surface of the nose fairing.

If it is desired to reduce the dimensions of the sleeve, will be necessary to install a shim on the aft section of the projectile as already described hereabove.

The aerodynamic forces brought to bear on the sabot and the nose fairing when they leave the weapon barrel will result in the breakage of the nose fairing and the release of the sub-projectile.

The projectile shown on FIG. 6 comprises a pusher-type sabot. In order to provide more volume for the grain charge, it is possible to design an amunition round wherein the sabot is of the "drawer" type, i.e. such that the resultant of the forces brought to bear on the sabot by the propellent gases has an application point well ahead of the sub-projectile center of gravity.

However, projectiles driven by a drawer-type sabot are highly sensitive to transverse pressure waves and, in that case, it will be absolutely necessary to install a shim on the aft section of the projectile so as to prevent it from tilting, whatever the length of contact between the sleeve and the nose fairing.

Figure 7A:
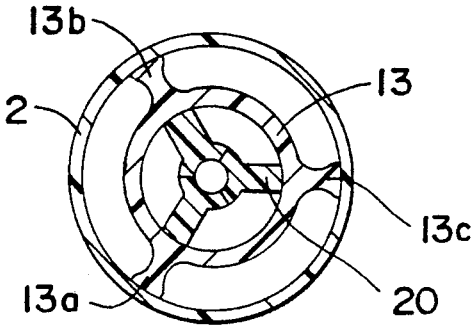
FIG. 7A is a cross-sectional view in plane C—C of FIG. 7.

So, on FIG. 7, an annular shim 13 of plastic material and comprising three evenly spaced arms 13*a*, 13*b*, 13*c* is made integral with the aft section of the sabot (see FIG. 7*a*). For that purpose, the sabot includes three extensions 20 on which the shim 13 is fitted. The sabot will be made integral with the shim by means of threads, glue or an interference fit.

The shim will break when the extensions pass through the sleeve; then the shim will be ejected behind the sabot and will not disturb the trajectory of the sub-projectile.

The extensions 20 will guide the projectile inside the weapon barrel.

On FIG. 8, the shim 13 is made integral with the projectile at the location of the fins.

The fitting is of the interference-fit type and the annular section of the shim 13 has thus a conical inner profile 22 supporting the external edges of the fins 17.

Figure 8A:
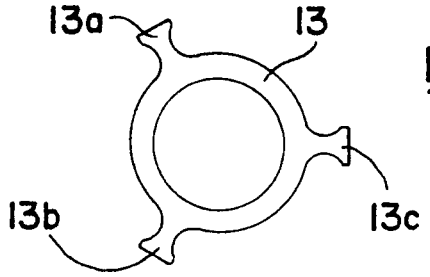
FIG. 8A is a front view of the shim alone which is used in the variant of FIG. 8.

Just like in the previous variant, the shim comprises three evenly spaced arms 13*a*, 13*b*, 13*c* (see FIG. 8A); the guidance is thus fulfilled without reducing the volume allowable for the propelling charge.

The shim will be mounted on the fin assembly so that the sub-projectile will pass through the latter, thus deforming the shim by the fins. Here again, the shim will break when passing through the sleeve and will be ejected behind the sabot without disturbing the trajectory of the sub-projectile.

Lastly, it is to be noted that the manufacture and loading of these various ammunition rounds is particularly easy; it suffices to use a base 5, whether metallic or not, distinct from the casing 2.

So, the projectile, carrying the nose fairing and the sleeve and possibly one or more shims, is first of all made integral with the casing, and then the propelling charge is introduced through the aft of the casing, the base being mounted lastly.

We claim:

1. A telescoped ammunition cartridge, comprising:

a generally cylindrical cartridge casing having one end closed by a base;

a full caliber projectile disposed within said cartridge casing, said projectile having a cylindrical aft section and a tapered fore-section;

at least one annular sleeve fitted inside said casing at a fore-section thereof, wherein said tapered fore-section of said projectile is located within said annular sleeve;

a detachable nose fairing fitted inside and contacting said at least one annular sleeve to define a nose fairing sleeve assembly, wherein said nose fairing is integral with said projectile and is located at the tapered fore-section of said projectile, said nose fairing sleeve assembly providing a support for the tapered fore-section of the projectile;

fixed supports comprising elongated ridges fitted between said nose fairing and said casing and extending to the aft section of the projectile to provide support therefor, wherein spaced are defined between said supports; and a propelling charge disposed within said casing, said propelling, charge being in contact with said cylindrical aft section of said projectile, wherein said propelling charge is disposed within said spaces between said fixed supports and said fixed supports are integral with and form one-piece with said at least one annular sleeve.

2. The telescoped ammunition cartridge of claim 1, wherein said generally cylindrical cartridge casing is made of plastic.

* * * * *